US005970939A

United States Patent [19]

Motosugi et al.

[11] Patent Number: 5,970,939

[45] Date of Patent: Oct. 26, 1999

[54] INTAKE MANIFOLD FOR ENGINE

[75] Inventors: Masato Motosugi, Hamamatsu; Takayuki Yoshida; Satoshi Takaki, both of Okazaki, all of Japan

[73] Assignees: Suzuki Motor Corporation, Shizuoka-ken; Futaba Industrial Co., Ltd., Aichi-ken, both of Japan

[21] Appl. No.: 09/129,807

[22] Filed: Aug. 6, 1998

[30] Foreign Application Priority Data

Aug. 8, 1997 [JP] Japan ..... 9-227288

[51] Int. Cl.[6] ..... F02M 35/00

[52] U.S. Cl. ..... 123/184.21; 123/184.61; 29/890.08

[58] Field of Search ..... 123/184.21, 184.24, 123/184.34, 184.42, 184.47, 184.61, 195 A; 29/890.08

[56] References Cited

U.S. PATENT DOCUMENTS

| | | | |
|---|---|---|---|
| 4,372,120 | 2/1983 | Ford, Jr. et al. | 60/605.1 |
| 4,829,944 | 5/1989 | Sukimoto et al. . | |
| 4,887,557 | 12/1989 | Sukimoto et al. . | |
| 5,012,770 | 5/1991 | Okamoto et al. | 123/184.42 |
| 5,253,616 | 10/1993 | Voss | 123/184.47 |
| 5,357,931 | 10/1994 | Semence | 123/456 |
| 5,400,951 | 3/1995 | Shiroyama et al. | 228/168 |
| 5,437,344 | 8/1995 | Wada | 160/291 |
| 5,477,819 | 12/1995 | Kopel | 123/184.42 |
| 5,642,697 | 7/1997 | Jahrens et al. | 123/184.21 |
| 5,771,863 | 6/1998 | Daly | 123/456 |
| 5,823,156 | 10/1998 | Thiel et al. | 123/184.31 |

FOREIGN PATENT DOCUMENTS

| | | | |
|---|---|---|---|
| 404350353 | 12/1992 | Japan | 123/184.42 |
| 405010220 | 1/1993 | Japan | 123/184.42 |
| 6-5061 | 1/1994 | Japan . | |
| 7-45853 | 5/1995 | Japan . | |
| 2539226 | 7/1996 | Japan . | |

*Primary Examiner*—Noah P. Kamen
*Assistant Examiner*—Hai Huynh
*Attorney, Agent, or Firm*—Flynn, Thiel, Boutell & Tanis, P.C.

[57] ABSTRACT

The intake manifold includes a mounting flange formed as a forged or cast member and having a fuel injection valve-mounting portion provided on the mounting flange. Branch pipes are formed from iron series-containing pipe members, and are joined to the mounting flange. A plurality of mounting bosses can also be formed on the mounting flange to support a stiffener connected to a surge tank.

10 Claims, 3 Drawing Sheets

INTAKE MANIFOLD FOR ENGINE

FIELD OF THE INVENTION

This invention relates to an intake manifold for an engine and, in particular, to an intake manifold which exhibits a greater degree of freedom in shape, thereby providing a fuel injection valve-mounting portion thereon, and which further provides reduced ventilation resistance, fewer worked portions, and enhanced rigidity.

BACKGROUND OF THE INVENTION

In conventional vehicle engines, there is provided an intake manifold for introduction of intake air, which intake manifold has a mounting flange mounted on a cylinder head, a plurality of branch pipes successively arranged along the mounting flange, and a surge tank to which the branch pipes are connected.

More specifically, as illustrated in FIG. 5, an engine 102 has intake ports 106 formed in a cylinder head 104. An intake manifold 108 has branch pipes 110 which respectively communicate with the intake ports 106. In addition, the intake manifold 108 has a mounting flange 112 mountable on the cylinder head 104 at a side portion thereof, which mounting flange 112 is a metal, plate-like member. In this case, since the mounting flange 112 is formed of a metal plate, a fuel injection valve-mounting portion 114 is provided on the cylinder head 104. A fuel injection valve 116 is mounted on the mounting portion 114.

In general, the intake manifold is entirely formed either by a light alloy casting, such as an aluminum alloy, or by resin. When fabricated as a light alloy casting, a greater degree of freedom is present in shaping the intake manifold. However, an air passage (an air-fuel mixture passage) inside each of the branch pipes includes a coarser or rougher inner surface. This results in increased air flow resistance.

When formed by resin, then the intake manifold is lighter in weight and a greater degree of freedom is present in shaping the manifold. Further, the air passage has a smoother inner surface formed inside the branch pipe, and thus exhibits less ventilation or flow resistance. However, there is another inconvenience in that the strength/rigidity of the intake manifold is difficult to insure.

Further, there is also a known type of intake manifold formed by a combination of several individual members, in which the branch pipes are formed by iron series-containing pipe members, while the mounting flange is formed by an iron series-containing plate member (made of the plate metal).

When the branch pipes and the mounting flange are formed as individual members, the air passage inside each of the branch pipes has a smoother inner surface and thus ventilation resistance is reduced. Further, the intake manifold includes fewer worked portions. In addition, the intake manifold is less expensive. However, the intake manifold in this case has an inconvenience of having a lesser degree of freedom in the shaping thereof.

When the branch pipes and the mounting flange are formed by individual aluminum series-containing pipe members and an aluminum series-containing forged member, then the air passage inside each of the branch pipes has a smoother inner surface, and thus exhibits reduced ventilation resistance. However, the intake manifold in this case has yet another inconvenience of increased cost.

Examples of the above-discussed types of intake manifolds are disclosed in, e.g., published Japanese Examined Patent Application Nos. 7-45853 (1995) and 6-5061 (1994), and in published Japanese Patent No. 2539226 (1996). The intake manifold according to Japanese Patent Application No. 7-45853 includes a main pipe and a plurality of branch pipes. More specifically, the main pipe is open at one end, but is closed at the other end. In addition, the main pipe has a plurality of holes formed in a peripheral wall thereof. Further, an outwardly protruding flange is integrally provided surrounding each of the holes, through which flanges the branch pipes are connected to the main pipe. Each of the branch pipes is formed by extrusion. The extruded pipe is connected at one end to the above-mentioned outwardly protruding flange such that the two are snugly engaged with one another. Such a construction provides the intake manifold with a smooth inner surface, less air resistance, and improved intake efficiency.

Japanese Patent Application No. 6-5061 describes a method for producing the entire intake manifold in a simple manner, including the steps of: molding a plurality of aluminum-extruded pipe members, each of which includes a large number of linear grooves on an inner peripheral surface thereof, the linear grooves extending in the lengthwise direction of the pipe member; distorting each non-worked pipe member, thereby forming a spiral-like groove in the inner peripheral surface over the entire length thereof; bending the non-worked pipe members, thereby producing a plurality of branch pipes, each of which has the spiral-like groove defined in the inner peripheral surface over the entire length thereof; and, brazing the branch pipes onto a main pipe.

Lastly, according to Japanese Patent No. 2539226, a thicker portion is provided on a peripheral wall of a main pipe at a location where branch pipes are to be connected thereto. Holes are punched at the thicker portion, through which holes the branch pipes are connected to the main pipe. A radially extending portion is opened and formed at a peripheral surface of each of the holes. The radially extending portion extends from the outermost end by a predetermined length. One end of the branch pipe is inserted into the radially extending portion, and is then brazed to the main pipe. This process eliminates a need to provide both holes and cylindrically shaped, outwardly protruding portions for use in connection of branch pipes, as practiced in conventional manners. As a result, lower manufacturing costs and fewer manufacturing processes are realized.

In conventional intake manifolds, since the mounting flange is fabricated using a metal plate member, then the fuel injection valve-mounting portion cannot be provided on the mounting flange. Thus, the fuel injection valve must be mounted directly on the cylinder head. This brings about an inconvenience in that the fuel injection valve cannot be used on engines that do not have the fuel injection valve-mounting portion on the cylinder head.

With the mounting flange formed using a plate member made of metal plate, the fuel injection valve-mounting portion can be provided on the mounting flange by the same mounting flange being made larger in thickness. However, this causes inconveniences in that it takes a long time to work or form such thicker mounting flange, thereby increasing costs, and further potions of the mounting flange are also unnecessarily made larger in thickness, with a concomitant increase in weight.

Further, since the heat conductivity of an aluminum alloy and that of iron are 240 $W \cdot m^{-1}K^{-1}$ for 100° C. and 72 $W \cdot m^{-1}K^{-1}$ for 100° C., respectively, then the heat conductivity of the aluminum alloy is about three times as large as that of iron. Accordingly, with the intake manifold formed using the aluminum alloy, heat is readily conducted from the cylinder head to the intake manifold. The heat is then transferred to the fuel delivery pipes which include fuel passages, which pipes are provided on the branch pipes. As a result, fuel in the delivery pipes is heated. This causes another inconvenience in that harmful percolation (fuel volatility) is readily produced. A further inconvenience is that a complicated structure and high costs are involved when a fuel supply system is provided with a countermeasure to obviate the former inconvenience.

SUMMARY OF THE INVENTION

To obviate or minimize the above inconveniences, one aspect of the present invention provides an intake manifold for an engine having a mounting flange mounted on a cylinder head and a plurality of branch pipes successively arranged on the mounting flange, whereby the mounting flange is formed using either a forged member or a cast member, and wherein at least a fuel injection valve-mounting portion is provided on the mounting flange.

Another aspect of the present invention provides an intake manifold for an engine having a mounting flange mounted on a cylinder head and a plurality of branch pipes successively arranged on the mounting flange, wherein the mounting flange is formed using either a forged member or a cast member, the mounting flange being provided with a fuel injection valve-mounting portion and a stiffener-mounting boss, and wherein the branch pipes are formed from iron series-containing pipe members or steel pipes, the branch pipes being successively arranged on a surge tank, and the surge tank being formed from the iron series-containing pipe member or steel pipe.

Pursuant to the present invention, the mounting flange is made by either forging or casting, with a consequential increase in freedom in shaping the flange. Thus, the mounting flange can be provided with the fuel injection valve-mounting portion and at least one stiffener-mounting boss. The fuel injection valve is thereby mountable on the intake manifold. When the mounting flange is formed from a forged member, manufacturing costs increase due to the cost of a mold used in working the forged member itself. In addition, the forged member provides a lesser amount of freedom in work shape, when compared with the cast member. However, the branch pipes can readily be welded onto the mounting flange. When the mounting flange is fabricated from a cast member, then it becomes difficult to weld the branch pipes onto such a mounting flange, and it is essentially impossible to attach the pipes to the flange by brazing. However, a mold used to form the cast member costs less. In addition, forming the flange by casting provides a greater degree of freedom in shaping the flange than forming the flange by forging. Moreover, since iron series-containing pipe members or steel pipes form the branch pipes, the intake manifold provides lower ventilation resistance and fewer worked portions. In addition, a stiffener is mounted on the stiffener-mounting bosses of the mounting flange, whereby enhanced rigidity of the entire intake manifold is achievable.

BRIEF DESCRIPTION OF THE DRAWINGS

An embodiment of the present invention will now be described in specific detail with reference to the drawings in which.

DETAILED DESCRIPTION

Figure 1:
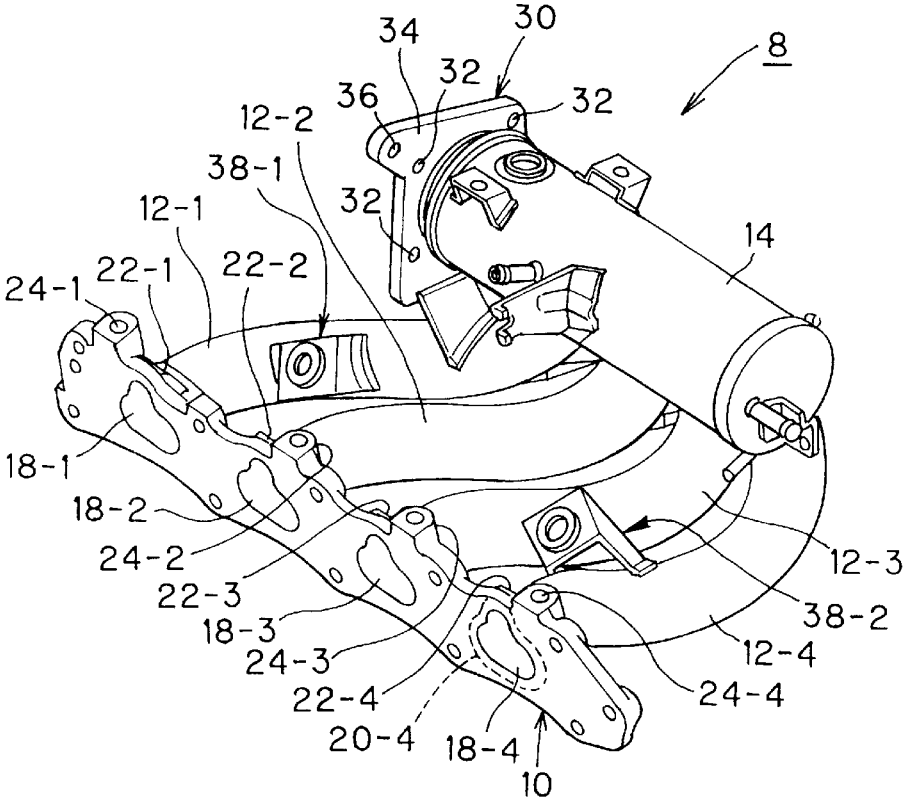
FIG. 1 is a perspective front view of an intake manifold according to the invention.
Figure 2:
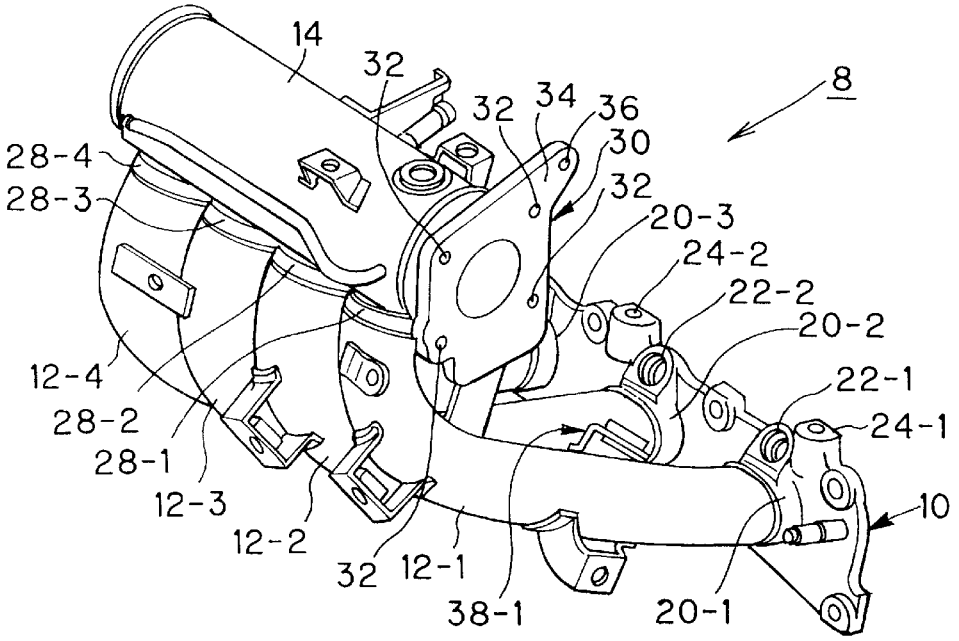
FIG. 2 is a perspective rear view thereof.
Figure 3:
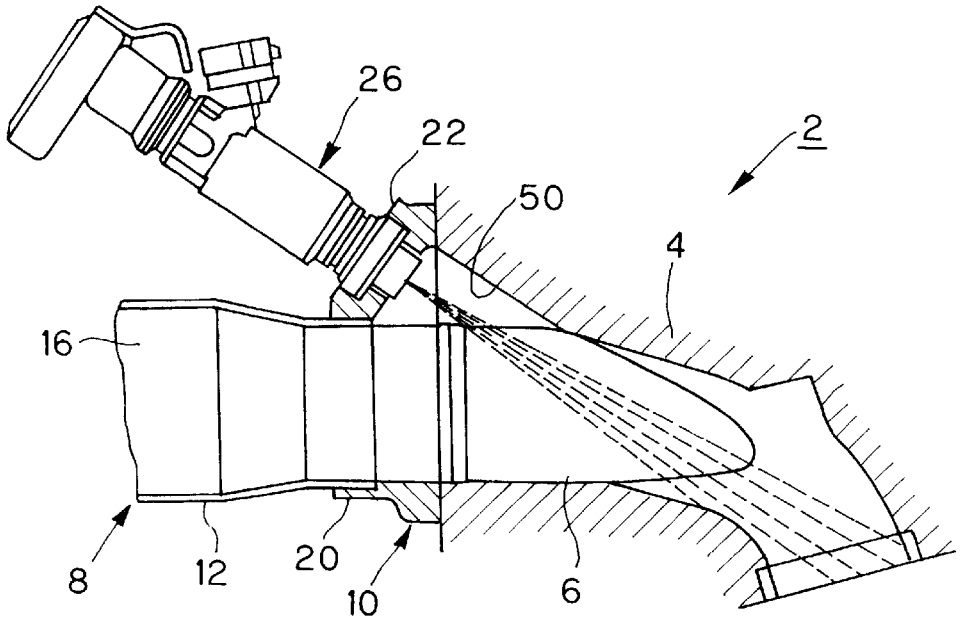
FIG. 3 is a fragmentary cross-sectional view thereof and showing the intake manifold mounted on a cylinder head.

FIGS. 1–4 illustrate an embodiment of the invention. In FIG. 3, reference numerals 2 and 4 denote a vehicle engine and a cylinder head, respectively. The cylinder head 4 has intake ports formed therein, one of which is depicted by numeral 6. An intake manifold 8 is mounted on the cylinder head 4 at a side portion thereof.

As illustrated in FIGS. 1 and 2, the intake manifold 8 of this invention is of an integral structure that includes a mounting flange 10 (for example plural four), branch pipes 12-1, 12-2, 12-3, 12-4, and a surge tank 14. The mounting flange 10 is mounted on the cylinder head 4 (FIG. 3). The branch pipes 12-1 through 12-4 are arranged in series along the mounting flange 10 such that one end of each branch pipe is connected to the mounting flange 10 and the other end of each branch pipe is connected to the surge tank 14. An air passage 16 is defined in each of the branch pipes 12-1, 12-2, 12-3 and 12-4, as represented by branch pipe 12 in FIG. 3.

The flange 10 is formed by, e.g., a forged member made from carbon steels. The flange 10 defines port openings 18-1, 18-2, 18-3, 18-4 and flange-side pipe connections or sleeves 20-1, 20-2, 20-3, 20-4. The portion openings 18-1 through 18-4 correspond to and communicate with the passages 16 of branch pipes 12-1 through 12-4, respectively. One end of each of the branch pipes 12-1 through 12-4 are fitted and inserted into the flange-side pipe connections 20-1 through 20-4, respectively. In addition, fuel injection valve-mounting portions 22-1, 22-2, 22-3 and 22-4 are provided in sequence in the pipe connections 20-1 through 20-4, respectively. Further, stiffener-mounting bosses 24-1, 24-2, 24-3 and 24-4 are arranged in spaced relation on an upwardly facing edge surface of the flange 10. The mounting flange 10 can thus be provided with the fuel injection valve-mounting portions 22-1, 22-2, 22-3 and 22-4 and the stiffener-mounting bosses 24-1, 24-2, 24-3 and 24-4 because the mounting flange 10 is formed by or from a forged member which provides a greater degree of freedom in shaping the flange 10, as opposed to conventional methods in which the mounting flange is formed as a plate member that is made of conventional metal plate.

A fuel injection valve 26 is mounted on each of the fuel injection valve-mounting portions 22-1, 22-2, 22-3 and 22-4, which are represented by valve mounting portion 22 in FIG. 3. The valve 26 is directed to and communicates with the intake port 6.

The surge tank 14 is formed from an iron series-containing pipe member made from cold-rolled steel plates, sheet or strip. The hollow surge tank 14 includes an inner surface which is either galvanized or painted. The surge tank 14 is provided with tank-side pipe connections or sleeves 28-1, 28-2, 28-3 and 28-4. The ends of each of the branch pipes opposite the ends connected to flange 10 inserted into the tank-side pipe connections 28-1 through 28-4, respectively. In addition, a throttle body-mounting flange or plate 30 is fixedly provided on an end surface of the surge tank 14. The mounting flange 30 is fabricated using an iron series-containing plate member made from hot-rolled steel plate, sheet or strip. The flange 30 is provided with a plurality and preferably four body-mounting holes 32 and a stiffener-mounting portion 34 at an upper end thereof. The stiffener-mounting portion 34 defines a bolt hole 36. The flange 30 has a central opening therethrough for communication with the interior of the surge tank.

The branch pipes 12-1, 12-2, 12-3 and 12-4 are formed from an iron series-containing pipe members made from carbon steels. Each of the branch pipes has an inner surface which is either galvanized or painted. The branch pipes 12-1 and 12-3 are provided with first and second fuel delivery pipe-mounting bosses or brackets 38-1 and 38-2, respectively, fixedly mounted thereon. Fuel delivery pipes (not shown), having fuel passages formed therein, are respectively mounted on the bosses 38-1 and 38-2.

Figure 4:
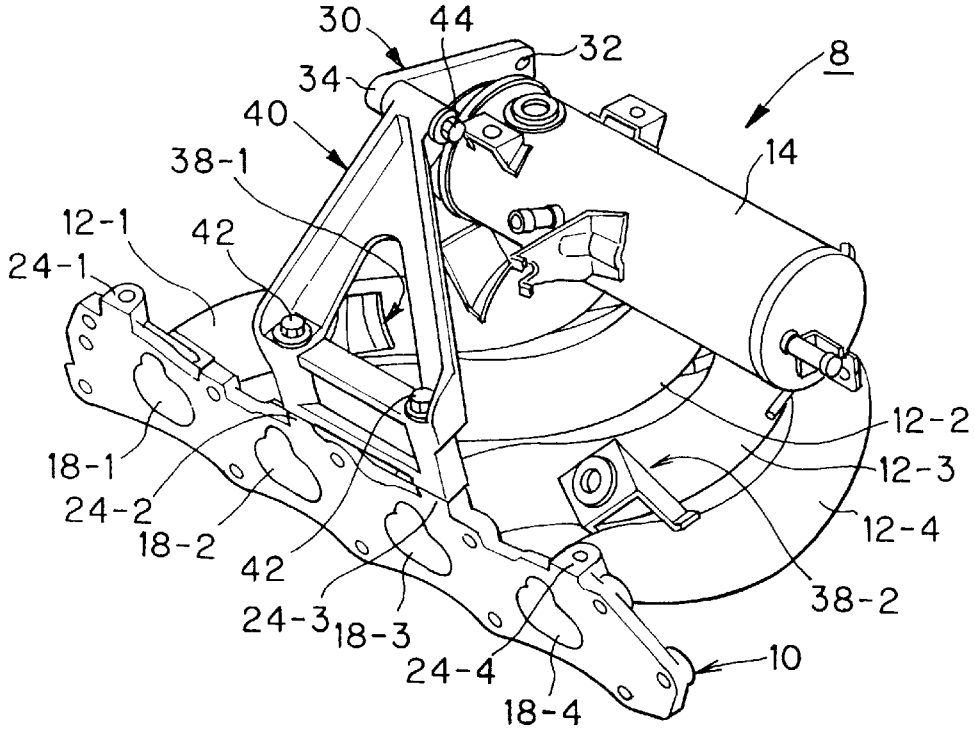
FIG. 4 is a perspective view of the invention manifold on which a stiffener is mounted.
Figure 5:
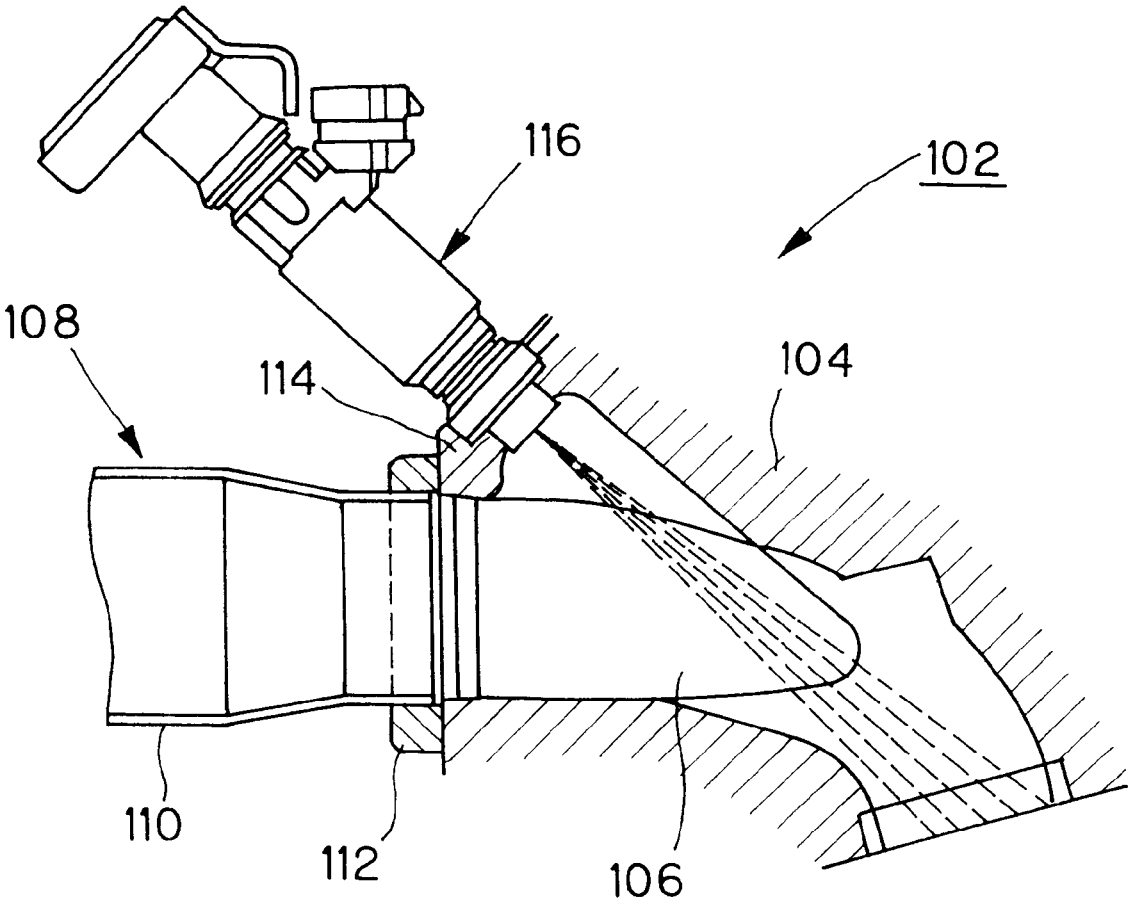
FIG. 5 PRIOR ART
FIG. 5 is a fragmentary cross-sectional view of a conventional intake manifold mounted on a cylinder head.

Referring now to FIG. 4, the mounting flange 10 and the surge tank 14 are directly rigidly coupled to one another by means of a stiffener 40. The stiffener 40 is fixed at one end to the bosses 24-2 and 24-3 by means of two respective mounting flange-side bolts 42, while being supported at the other end by a fixing bolt 44. The fixing bolt 44 is fitted and inserted through the fixing bolt hole 36 of the above-mentioned stiffener-mounting portion 34.

Next, the structural and functional advantages of the present embodiment will be described.

The mounting flange 10 of the intake manifold 8 is formed by forging, which provides a greater degree of freedom in shaping the mounting flange 10 when compared with conventional mounting flanges which are formed using metal plate members. Such formation of the flange 10 from a forged member adds to the cost of a mold used in working the forged member itself. In addition, the degree of freedom in shaping the forged member is less as compared with cast members. However, the branch pipes 12-1, 12-2, 12-3 and 12-4 can readily be welded onto the forged mounting flange 10.

As a result, the forged mounting flange 10 can be provided with the fuel injection valve-mounting portions 22, as illustrated in FIG. 3. Accordingly, with the cylinder head 4 of the engine 2 free of the fuel injection valve-mounting portions, the fuel injection valve 26 is simply mounted on the flange 10, which flange is then mountable on the intake manifold 8. In addition, the cylinder head 4 need only be machined to provide a cutout portion or recess 50 (FIG. 3) adjacent each valve mounting portion 22-1, 22-2, 22-3 and 22-4, so that fuel issuing from the respective fuel injection valves 26 is kept from being sprayed.

In the improved manifold of this invention, the opening 18 at the mounting face of the flange 10, and the mouth of the port 6 as defined in the side face of the cylinder head 4, are generally of a keyhole shape so as to accommodate the fuel injection valve.

In addition, the forged flange 10 can be provided with the stiffener-mounting bosses 24-1, 24-2, 24-3 and 24-4. The stiffener 40 is mounted on flange 10 by means of bosses 24-2 and 24-3 and connects the mounting flange 10 and the surge tank 14 together. The employment of the stiffener 40 enables improved rigidity of the entire intake manifold 8.

Further, the fuel injection valve-mounting portion 22-1, 22-2, 22-3 and 22-4, and the stiffener-mounting bosses 24-1, 24-2, 24-3 and 24-4 are formed by forging and thus are an integral and monolithic part of the one-piece forged flange 10. As a result, relatively lower manufacturing costs are achieved. In addition, if necessary, the mounting flange 10 can be provided with a reinforcement rib (not shown), and further can be reduced in thickness at any unnecessary portion thereof. As a result, the intake manifold 8 can be made lighter, while the strength and rigidity of the intake manifold 8 are insured. In addition, manufacturing costs are reduced.

Moreover, since the branch pipes 12-1, 12-2, 12-3 and 12-4 are produced from carbon steel pipe members, it is possible to provide reduced ventilation or flow resistance, fewer work portions, and reduced cost.

Pursuant to the present embodiment, the fuel delivery pipes (not shown) are mounted on the delivery pipe-mounting bosses 38 of the branch pipes 12-1 and 12-3 formed from the carbon steel pipe members. Accordingly, the heat conductivity of each of the branch pipes is sufficiently smaller than that of aluminum series-containing materials such that the occurrence of percolation (fuel volatility) inside the fuel delivery pipes is prevented or minimized.

Further, since the branch pipes are formed from carbon steel pipe members, the branch pipes exhibit a higher level of strength and rigidity than the aluminum series-containing pipe members, and thus can be reduced in thickness. As a result, it is possible to further reduce the heat conductivity of the branch pipes, and thus more effectively prevent the occurrence of fuel percolation.

Moreover, since the branch pipes and the surge tank 14 include respective galvanized or painted inner surfaces, then the air passages 16 of the branch pipes are defined by smooth inner surfaces which further reduce the flow resistance.

Pursuant to the present embodiment, the mounting flange 10 is formed by a forged member; however, the same flange 10 may be a cast member fabricated by casting. In this case, similar effects are obtainable. When the mounting flange 10 is formed by casting, then it is difficult to weld the branch pipes 12-1, 12-2, 12-3 and 12-4 onto such mounting flange 10, and it is essentially impossible to attach the branch pipes to flange 10 by brazing. Thus, the branch pipes must be permanently attached to mounting flange 10 by another method. However, the mold utilized to form the cast flange member costs less. In addition, a greater degree of freedom in shaping the flange 10 when compared to forming flange 10 by forging.

In summary, the intake manifold pursuant to the present invention includes the mounting flange formed as an integral and monolithic one-piece member which is formed as either a forged member or a cast member provided with the pipe connecting sleeves 20, the fuel injection valve-mounting portions 22 and the stiffener-mounting bosses 24 as an integral part thereof. In addition, since the branch pipes are produced from iron series-containing pipe members, the fuel injection valve is mountable on the intake manifold, and more specifically is mountable directly on the mounting flange. Further, the intake manifold provides lower flow resistance and requested fewer worked portions or parts. In addition, the improved rigidity of the intake manifold is attainable. Moreover, the intake manifold is available at relatively low cost.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. In an intake manifold for an engine, having a mounting flange mountable on a cylinder head and a plurality of branch pipes successively arranged on said mounting flange, the improvement wherein said mounting flange is formed using one of a forged member or a cast member, wherein at least a fuel injection valve-mounting portion which projects outwardly therefrom is provided on said mounting flange, and wherein said mounting flange includes a pipe mounting sleeve and a stiffener mounting boss.

2. The intake manifold of claim 1 wherein said branch pipes are formed from steel pipe members and are successively arranged on a surge tank, and wherein said surge tank is formed from a steel pipe member.

3. An intake manifold for an internal combustion engine having a cylinder head, said intake manifold comprising:

a surge tank;

a plurality of branch pipes each having a first end for connection to the surge tank and a second end;

a mounting flange for connecting said second ends of said branch pipes to the cylinder head, said mounting flange including a mounting portion configured for mounting a fuel-injection valve thereon;

a plurality of mounting bosses joined to said mounting flange; and a stiffener connected between said mounting bosses and said surge tank.

4. The intake manifold of claim 3 wherein said mounting portion, said mounting bosses and said mounting flange together form an integral, monolithic, one-piece forged or cast component.

5. The intake manifold of claim 4 wherein said mounting flange includes a plurality of openings therethrough, said mounting flange including a pipe mounting sleeve disposed adjacent an outer end of each said opening, said sleeve being an integral and monolithic part of said mounting flange, and each said mounting portion projecting radially outwardly from a respective said pipe mounting sleeve.

6. The intake manifold of claim 5, wherein said mounting bosses are joined to said mounting flange along one edge thereof in spaced relation therealong.

7. An intake manifold for an internal combustion engine having a cylinder head, said intake manifold comprising:

a surge tank;

a plurality of branch pipes each having a first end for connection to the surge tank and a second end;

a mounting flange for connecting said second ends of said branch pipes to the cylinder head, said mounting flange having a mounting portion configured for mounting a fuel-injection valve thereon, said mounting flange also including at least one boss portion configured for mounting thereon a stiffener for interconnecting the surge tank and said mounting flange, and said boss portion and said mounting flange together forming an integral, monolithic, one-piece component.

8. The intake manifold of claim 3 wherein and at least one of said branch pipes includes a mounting bracket thereon disposed to support a fuel delivery pipe, said one branch pipe being constructed of steel to minimize heating of fuel in the fuel delivery pipe.

9. The intake manifold of claim 3 wherein a first said surge tank and said branch pipes are each constructed of steel and include a smooth interior surface to reduce flow resistance in said intake manifold.

10. A method of making a mounting flange for an intake manifold for connecting a plurality of branch pipes of the intake manifold to a cylinder head of an internal combustion engine, said method comprising forming said mounting flange by one of forging or casting, said step of forming including forming a mounting portion on said mounting flange for receiving therein a fuel-injection valve, and wherein said step of forming includes forming a boss on said mounting flange for mounting thereon a stiffener for interconnecting said mounting flange and a surge tank.

* * * * *